US009126657B2

(12) United States Patent
Shearer et al.

(10) Patent No.: US 9,126,657 B2
(45) Date of Patent: Sep. 8, 2015

(54) LOW COST BOAT ENCLOSURE

(71) Applicant: Taylor Made Group, LLC, Gloversville, NY (US)

(72) Inventors: Robert R. Shearer, Bradenton, FL (US); Dennis J. Parniske, Parrish, FL (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 0 days.

(21) Appl. No.: 14/041,930

(22) Filed: Sep. 30, 2013

(65) Prior Publication Data

US 2014/0090591 A1 Apr. 3, 2014

Related U.S. Application Data

(60) Provisional application No. 61/707,649, filed on Sep. 28, 2012.

(51) Int. Cl.
*B63B 17/02* (2006.01)
*B63B 19/02* (2006.01)

(52) U.S. Cl.
CPC ..... *B63B 17/02* (2013.01); *B63B 19/02* (2013.01); *B63B 2221/14* (2013.01)

(58) Field of Classification Search
CPC ..... B63B 17/00; B63B 17/02
USPC ..... 114/361; 135/115, 117, 119
See application file for complete search history.

(56) References Cited

U.S. PATENT DOCUMENTS 3,698,409 A * 10/1972 Koontz et al. ..... 114/361
7,418,919 B2 * 9/2008 Smith et al. ..... 114/361

* cited by examiner

*Primary Examiner* — Lars A Olson
(74) *Attorney, Agent, or Firm* — Nixon & Vanderhye P.C.

(57) ABSTRACT

A portable boat enclosure includes a plurality of separable panels formed of a lightweight material and a storage bag. The panels are connectable into a boat enclosure, and the panels are sized and shaped to be overlaid, folded and rolled to fit in the storage bag.

10 Claims, 11 Drawing Sheets

LOW COST BOAT ENCLOSURE

CROSS-REFERENCES TO RELATED APPLICATIONS

This application claims the benefit of U.S. Provisional Patent Application Ser. No. 61/707,649, filed Sep. 28, 2012, the entire content of which is herein incorporated by reference.

STATEMENT REGARDING FEDERALLY SPONSORED RESEARCH OR DEVELOPMENT (Not Applicable)

BACKGROUND OF THE INVENTION

The invention relates to a low cost and portable boat enclosure.

Existing full canvas boat enclosures can be expensive and difficult to install. Additionally, the full canvas enclosures typically utilize a bulky material that is difficult to stow/store.

BRIEF SUMMARY OF THE INVENTION

It would be desirable to provide a low cost and easily portable boat enclosure.

The enclosure is generally made of lightweight and low cost materials. The enclosure has a limited number and size of flexible translucent panels that allow for outside view about discreet positions. This reduces cost as well as allows for the enclosure to be stowed as a small package. As discussed in more detail below, the entire enclosure can be stored in a small bag and stowed easily on the boat. In an exemplary application, the enclosure is suitable as a temporary enclosure that is easy and quick to erect and will temporarily keep boat passengers safe from inclement weather or the like. The enclosure requires a minimum number of attachment points or fasteners (snaps, studs, bungee attachments, etc.). Additionally, the enclosure utilizes low cost fabrication and sewing techniques. The resulting structure is a low cost alternative to the traditional full canvas enclosure that is easy to erect and requires minimal space for stowing.

In an exemplary embodiment, a portable boat enclosure includes a front panel, a rear panel, and two side panels. The front panel and the rear panel include panel connectors for attachment to the side panels, and at least the front panel and the rear panel include boat connectors for attachment to a boat. The side panels may also include boat connectors for attachment to a boat. Each of the front panel and the rear panel may have a window. In this context, the window of the front panel and the window of the rear panel may be of equal size. Each of the front panel, the rear panel and the side panels may be formed of canvas. The panel connectors may be zippers. The boat panels may be one of snaps, studs, hook and loop fasteners, and bungee attachments. The enclosure may also include a storage bag into which the front panel, the rear panel and the side panels can be folded and stored. The side panels may include channels that are sized to receive a bimini top support bar.

In another exemplary embodiment, a portable boat enclosure includes a plurality of separable panels formed of a canvas material and a storage bag. The panels are connectable into a boat enclosure, and the panels are sized and shaped to be overlaid, folded and rolled to fit in the storage bag. A bottom line of a front panel window and a bottom line of a rear panel window may serve to define a fold point for fitting the plurality of panels into the storage bag. The front panel window and the rear panel window may define a fold width for fitting the plurality of panels into the storage bag.

In yet another exemplary embodiment, a method of storing a portable boat enclosure into a storage bag includes the steps of (a) with the rear panel on a flat surface, overlaying the front panel on the rear panel with a bottom of the front panel window aligned with a bottom of the rear panel window; (b) overlaying the side panels on the front panel with a bottom of the side panel windows aligned with the bottom of the front panel window; (c) folding the overlaid panels along a line defined by the aligned bottoms of the respective windows; (d) folding the overlaid panels by a width corresponding to a width of the respective windows in succession until a width of the folded overlaid panels substantially corresponds to the width of the respective windows; (e) rolling the overlaid and folded panels in a direction opposite from a folding direction in steps (c) and (d); and (f) inserting the overlaid, folded and rolled panels into the storage bag.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
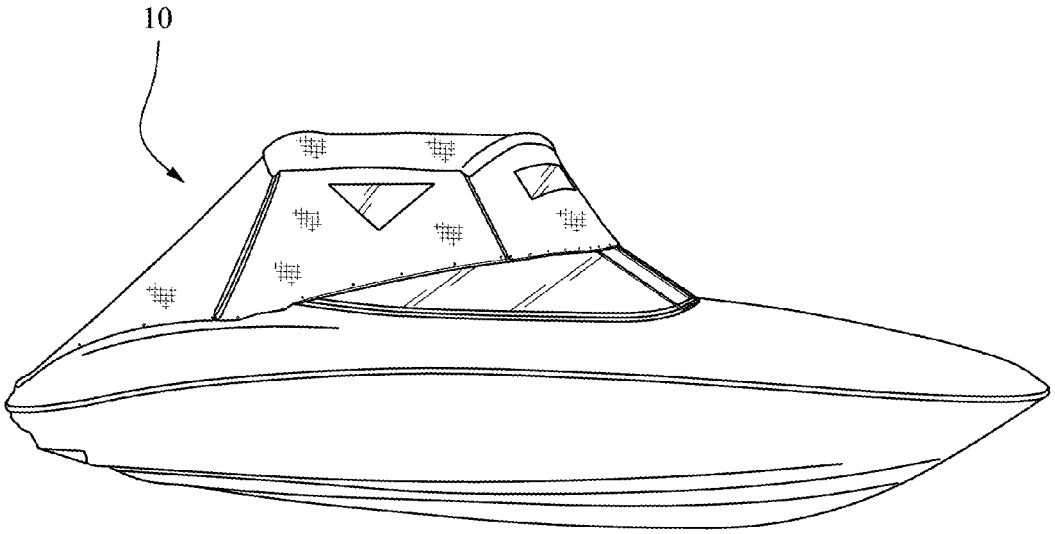
FIG. 1 is a side perspective view of the enclosure installed on a boat.
Figure 2:
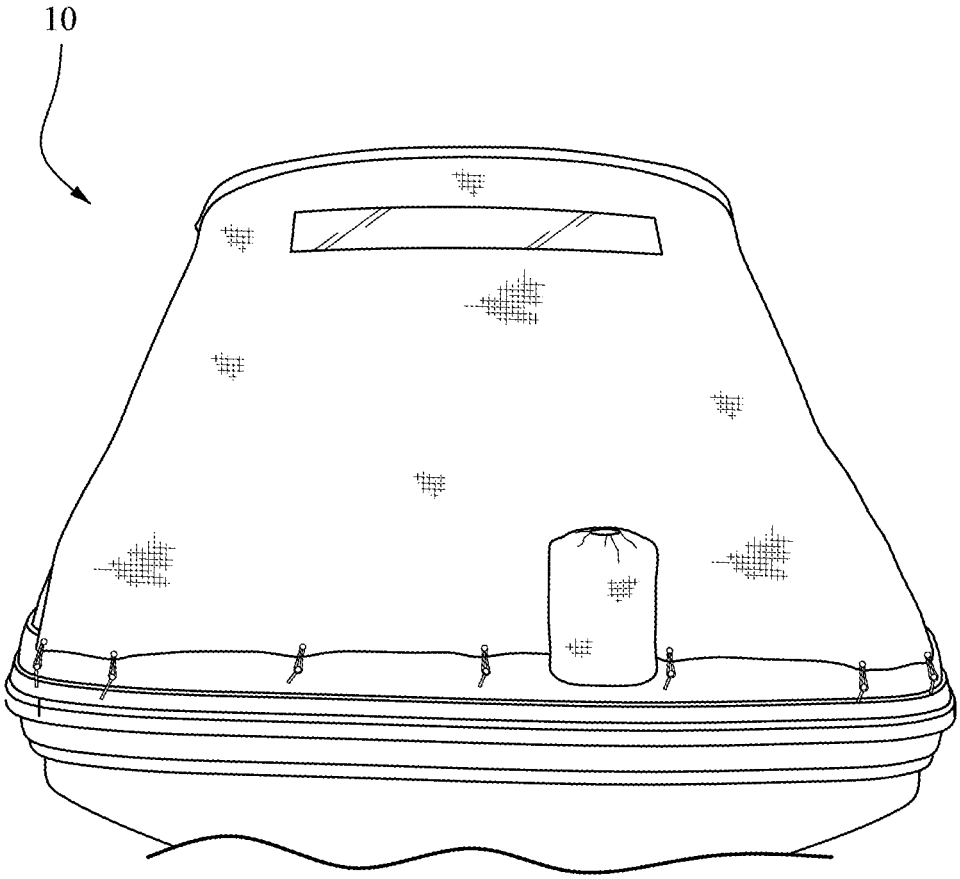
FIG. 2 is a rear view of the enclosure and including the storage bag.
Figure 3:
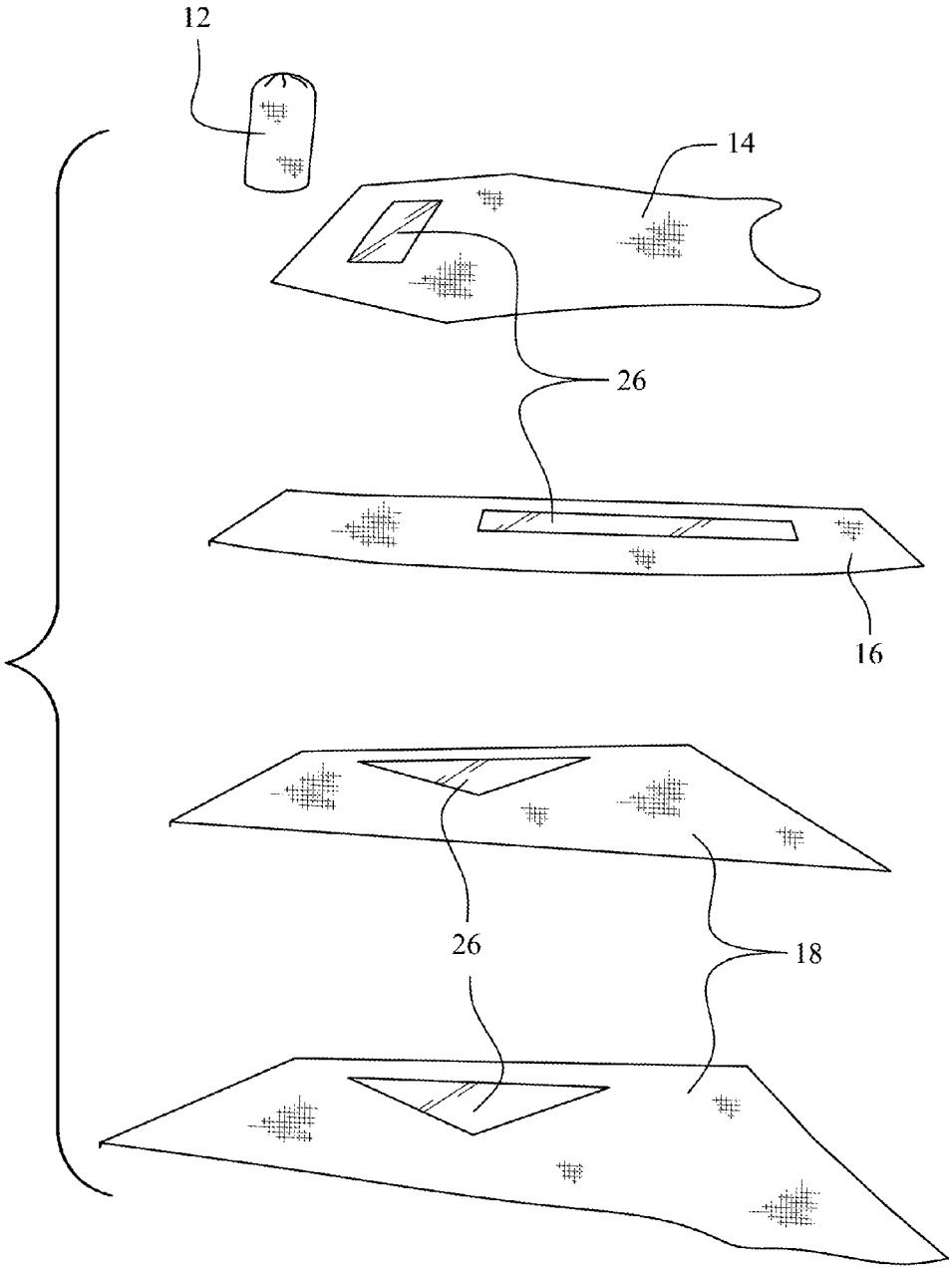
FIG. 3 shows the components of the enclosure.
Figure 4:
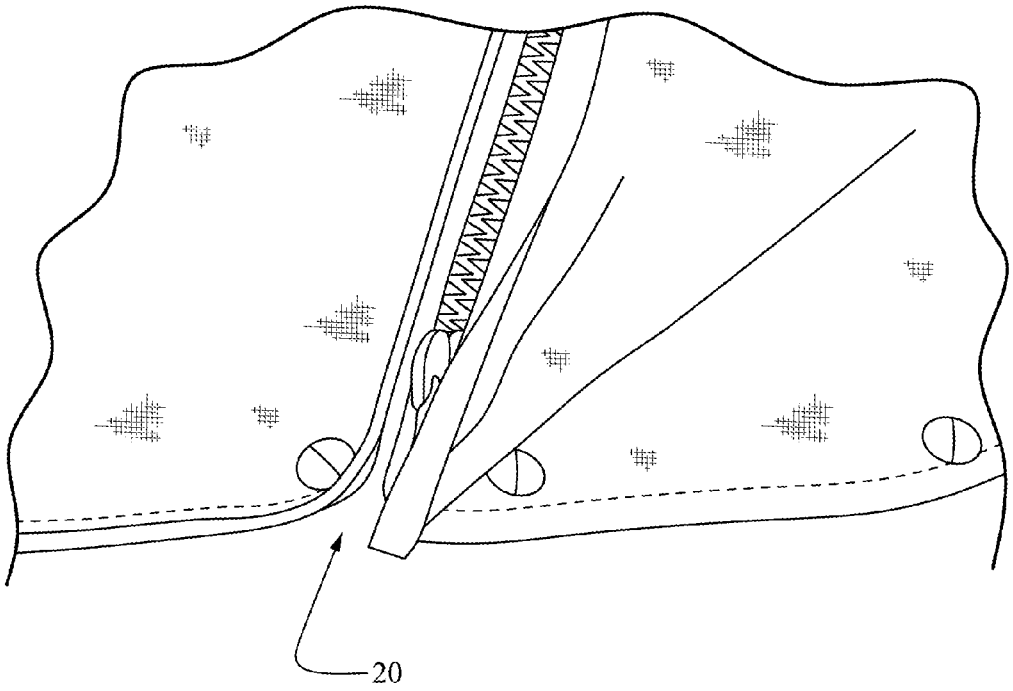
FIGS. 4 and 5 show an exemplary connector for the enclosure components.
Figure 5:
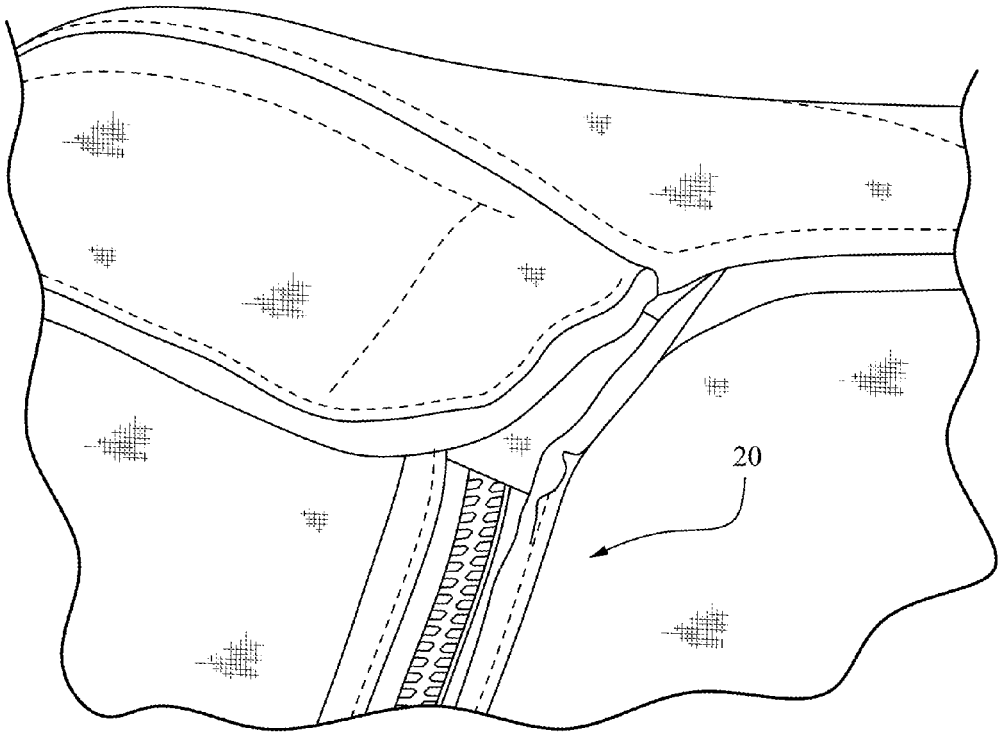
Figure 6:
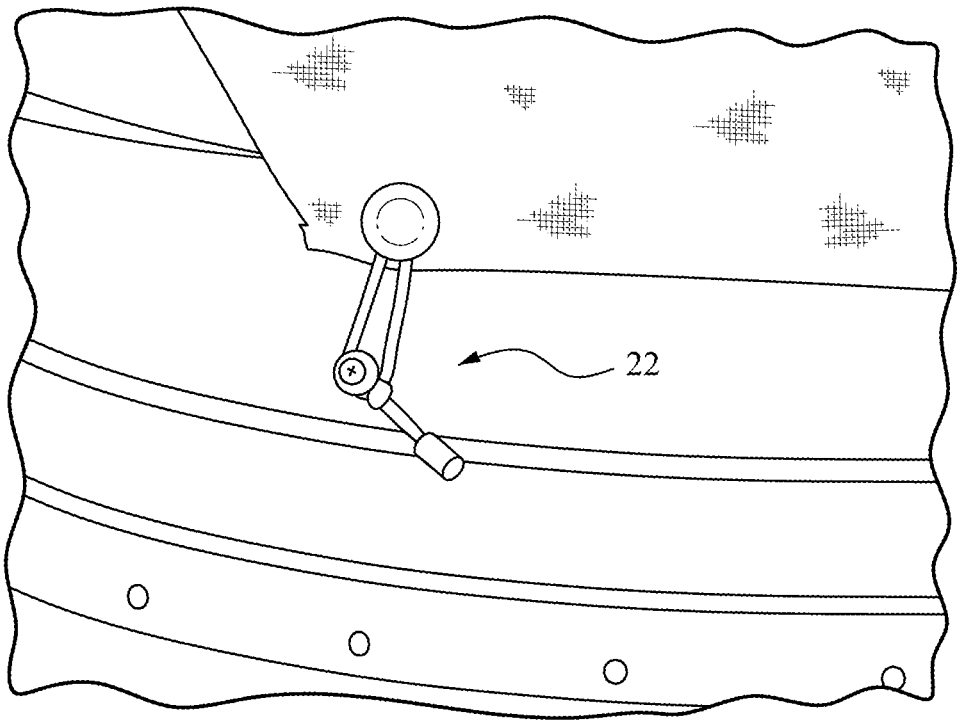
FIG. 6 shows a bungee attachment to the boat.
Figure 7:
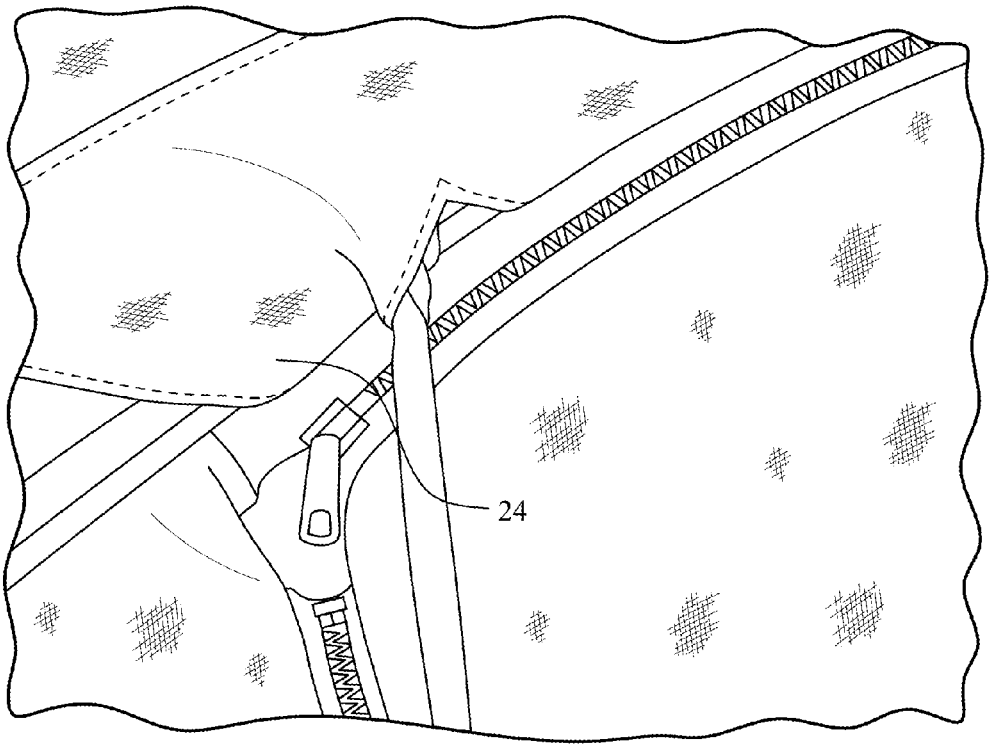
FIG. 7 shows channels in the enclosure for receiving bimini top frame members.

FIGS. 1 and 2 show the low cost and portable boat enclosure of the preferred embodiments assembled and installed on a boat. With reference to FIG. 3, the enclosure 10 generally comprises four panels and a bag 12 for storage. From top to bottom in FIG. 3, the panels include a rear panel 14, a front panel 16, and two side panels 18. The panels are formed of a lightweight canvas such as clear roll vinyl, solution dyed polyester, and solution dyed acrylic or other synthetic materials. Other materials may be suitable. As shown in FIGS. 4 and 5, the panels are connectable via zippers 20 or the like and may be secured to the boat via snaps or other suitable connections. Portions of the enclosure may additionally or alternatively be secured via bungee cord or ties 22 as shown in FIG. 6. Hook and loop fasteners may also be used. The enclosure panels include channels 24 or the like for receiving cross bars of a boat bimini top (see FIG. 7). Each of the panels may include a window 26. An exemplary preferred material for the windows 26 is 30-gauge roll clear vinyl.

Figure 8:
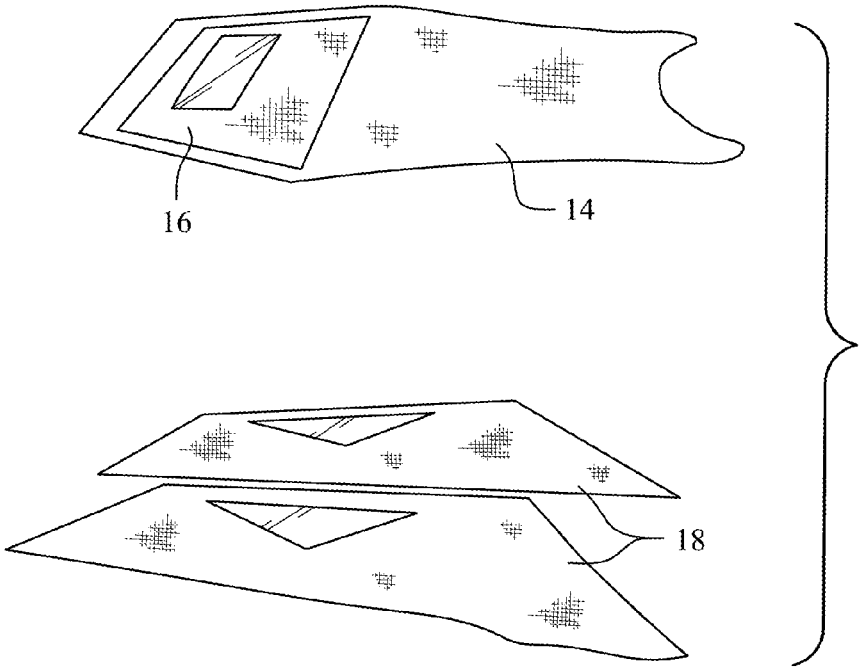
FIGS. 8-14 show the process of folding the enclosure components for storage in the storage bag.
Figure 9:
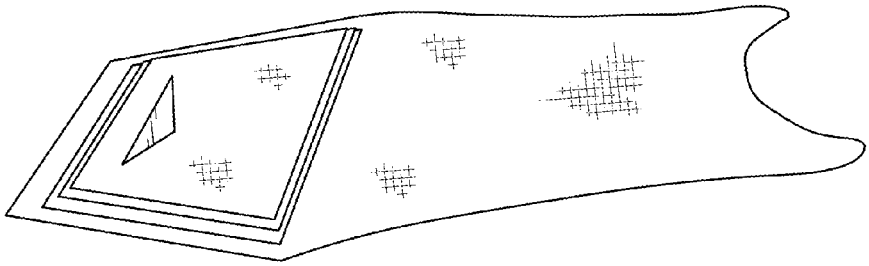

FIGS. 8-14 show the enclosure panels being folded together for storage. As shown in FIG. 8, the front panel 16 is positioned over the rear panel 14 such that the windows 26 are aligned. The window 26 in the front panel 16 and the window 26 in the rear panel 14 are preferably of equal size. In FIG. 9, the side panels 18 are placed over top of the front panel with the bottom portions of the side windows 26 aligned with bottom portions of the front and rear windows 26. This line created by the bottom portions of the windows defines a first fold line 28 for the enclosure.

Figure 10:
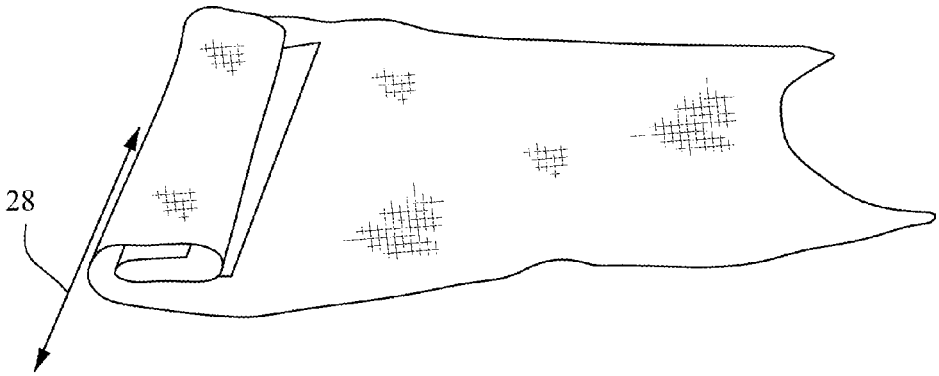
Figure 11:
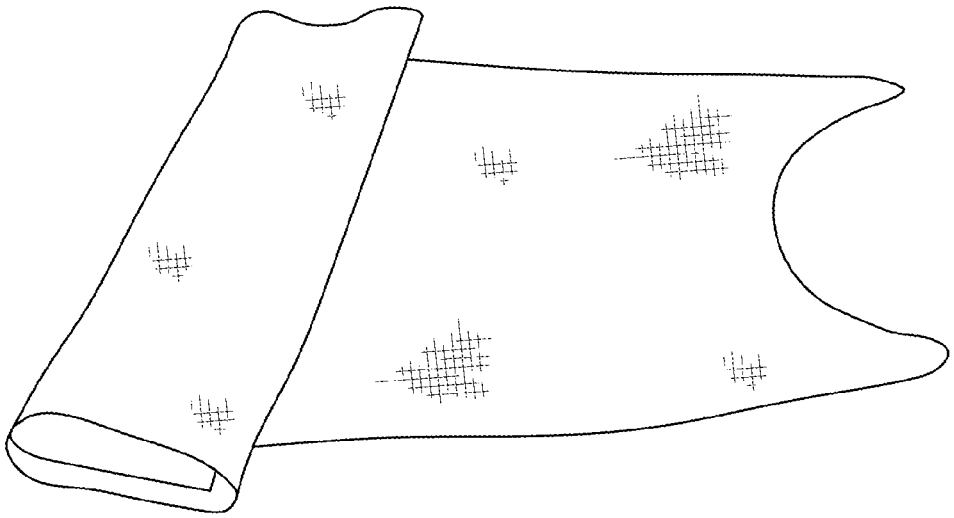
Figure 12:
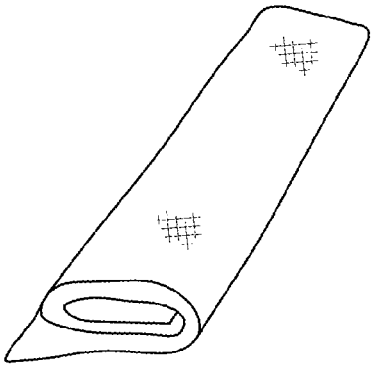
Figure 13:
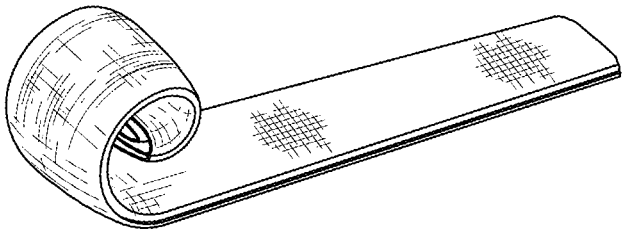
Figure 14:
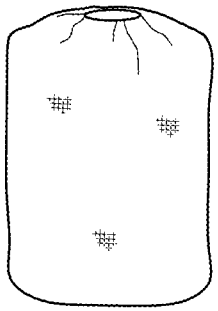

As shown in FIGS. 10-12, the panels are then folded by an amount corresponding to about the width of the windows 26 in succession. Ends of the folded assembly are subsequently folded toward each other, and as shown in FIG. 13, the folded enclosure is then rolled on itself in a direction generally perpendicular to the folding direction. After rolling is complete, the folded and rolled enclosure is fit into the storage bag 12 for portability and storage (see FIG. 14).

The invention provides for an inexpensive and easily assembled boat enclosure. Additionally, components of the boat enclosure can be overlaid, folded and rolled for storage into a storage bag.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A portable boat enclosure comprising:

a front panel;

a rear panel separated from the front panel; and two side panels separated from each other and from the front and rear panels, wherein the front panel and the rear panel include panel connectors for attachment to the side panels, and wherein at least the front panel and the rear panel include boat connectors for attachment to a boat, and wherein at least the side panels comprise channels that are sized to receive a bimini top support bar.

2. A portable boat enclosure according to claim 1, wherein the side panels include boat connectors for attachment to a boat.

3. A portable boat enclosure according to claim 1, wherein each of the front panel and the rear panel comprises a window.

4. A portable boat enclosure according to claim 3, wherein the window of the front panel and the window of the rear panel are of equal size.

5. A portable boat enclosure according to claim 1, wherein each of the front panel, the rear panel and the side panels are formed of one of clear roll vinyl, solution dyed polyester, solution dyed acrylic and other synthetic materials.

6. A portable boat enclosure according to claim 1, wherein the panel connectors comprise zippers.

7. A portable boat enclosure according to claim 1, wherein the boat panels comprise one of snaps, studs, hook and loop fasteners, and bungee attachments.

8. A portable boat enclosure according to claim 1, further comprising a storage bag into which the front panel, the rear panel and the side panels can be folded and stored.

9. A portable boat enclosure comprising a plurality of selectively separable panels formed of a canvas material and a storage bag, wherein the panels are connectable into a boat enclosure, and wherein the panels are sized and shaped to be overlaid, folded and rolled to fit in the storage bag, wherein the plurality of selectively separable panels comprise a front panel, a rear panel, and two side panels, wherein the front panel and the rear panel include panel connectors for attachment to the side panels, wherein each of the front panel and the rear panel comprises a window, wherein the window of the front panel and the window of the rear panel are of equal size, wherein a bottom line of the front panel window and a bottom line of the rear panel window define a fold point for fitting the plurality of panels into the storage bag, and wherein the front panel window and the rear panel window define a fold width for fitting the plurality of panels into the storage bag.

10. A method of storing a portable boat enclosure into a storage bag, the portable boat enclosure including a front panel, a rear panel, and two side panels, each of the front panel, the rear panel and the side panels including a window, the method comprising:

(a) with the rear panel on a flat surface, overlaying the front panel on the rear panel with a bottom of the front panel window aligned with a bottom of the rear panel window;

(b) overlaying the side panels on the front panel with a bottom of the side panel windows aligned with the bottom of the front panel window;

(c) folding the overlaid panels along a line defined by the aligned bottoms of the respective windows;

(d) folding the overlaid panels by a width corresponding to a width of the respective windows in succession until a width of the folded overlaid panels substantially corresponds to the width of the respective windows;

(e) rolling the overlaid and folded panels in a direction opposite from a folding direction in steps (c) and (d); and (f) inserting the overlaid, folded and rolled panels into the storage bag.

* * * * *